US008854926B2

(12) United States Patent
Lin

(10) Patent No.: US 8,854,926 B2
(45) Date of Patent: Oct. 7, 2014

(54) MULTI-LANE STOP WATCH

(76) Inventor: Yingjie Lin, El Paso, TX (US)

( * ) Notice: Subject to any disclaimer, the term of this patent is extended or adjusted under 35 U.S.C. 154(b) by 338 days.

(21) Appl. No.: 13/461,897

(22) Filed: May 2, 2012

(65) Prior Publication Data

US 2013/0294206 A1 Nov. 7, 2013

(51) Int. Cl.
*G04F 10/00* (2006.01)

(52) U.S. Cl.
USPC ..... 368/110; 368/113

(58) Field of Classification Search
USPC ..... 368/107, 110–113
See application file for complete search history.

(56) References Cited

U.S. PATENT DOCUMENTS

| | | | | |
|---|---|---|---|---|
| 4,236,239 | A * | 11/1980 | Imgruth et al. | 368/72 |
| 4,797,864 | A * | 1/1989 | Stano et al. | 368/111 |
| 5,140,563 | A * | 8/1992 | Thinesen | 368/70 |
| 8,619,505 | B2 * | 12/2013 | Burton et al. | 368/113 |
| 2009/0257323 | A1 * | 10/2009 | Soltani | 368/281 |

* cited by examiner

*Primary Examiner* — Vit W Miska
(74) *Attorney, Agent, or Firm* — Oakwood Law Group, LLP

(57) ABSTRACT

An electronic multi-lane stop watch is disclosed. Said multi-lane stop watch can record multi-athletes' split times and final times simultaneously. Said multi-lane stop watch can also automatically save collected data to files and export/import information and data to/from external devices such as computers or printers.

9 Claims, 4 Drawing Sheets

MULTI-LANE STOP WATCH

BACKGROUND OF THE INVENTION

Field of the Invention

The present invention relates to an electronic timing device, more particularly to a multi-lane stop watch.

Traditional stop watch can only do Start/Split/Stop. The recall function can only recall the splits from last measurement. When the stopwatch re-starts, the old split time and final time are erased and cannot be recalled any more. Traditional stop watch also only works for one athlete Splits. Some coaches have to use two stop watches during the meet if there are more athletes race at the same heat. Traditional stop watch also does not have the function to permanently store or save split times. Coaches have to write down the split and final time between races during the meet.

What is needed is a stop watch which can get more than one athlete splits and final times simultaneously and automatically save and store the results in file which can be reviewed or print out later.

SUMMARY OF THE INVENTION

In an exemplary embodiment of the present invention, there is disclosed an electronic timing device, more particularly to a multi-lane stop watch. Said multi-lane stop watch can record multi-athletes' split times and final times simultaneously. Said multi-lane stop watch can also automatically save collected data to files and export/import information and data to/from external devices such as computers or printers.

Said multi-lane stop watch is comprised of a main micro-controller, a timing unit, an input unit, a display unit, means to import/export data, means of data and information storages, and a power supply unit.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1A:
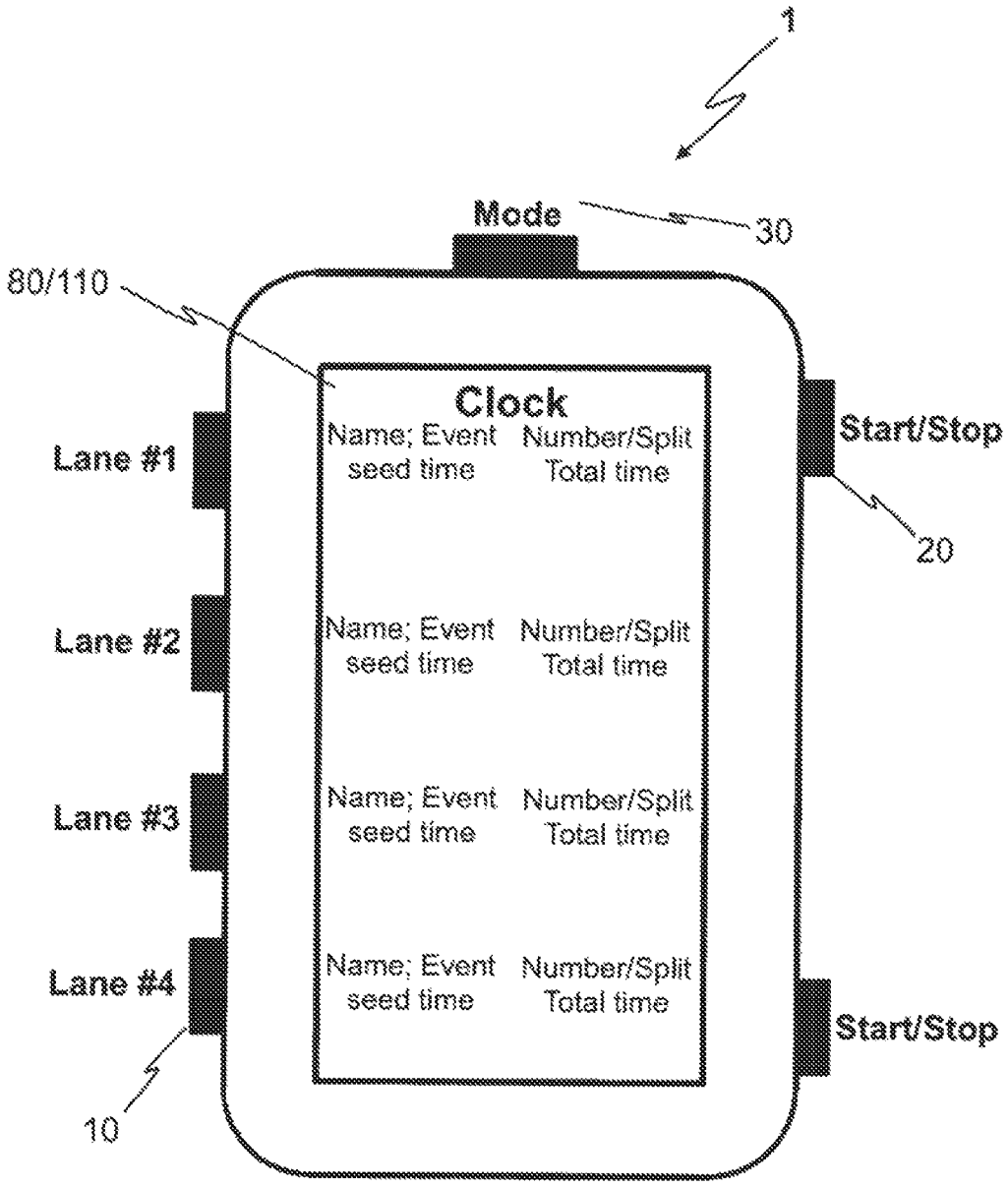
FIG. 1A and FIG. 1B shows the appearance of one embodiment of the present invention.
Figure 1B:
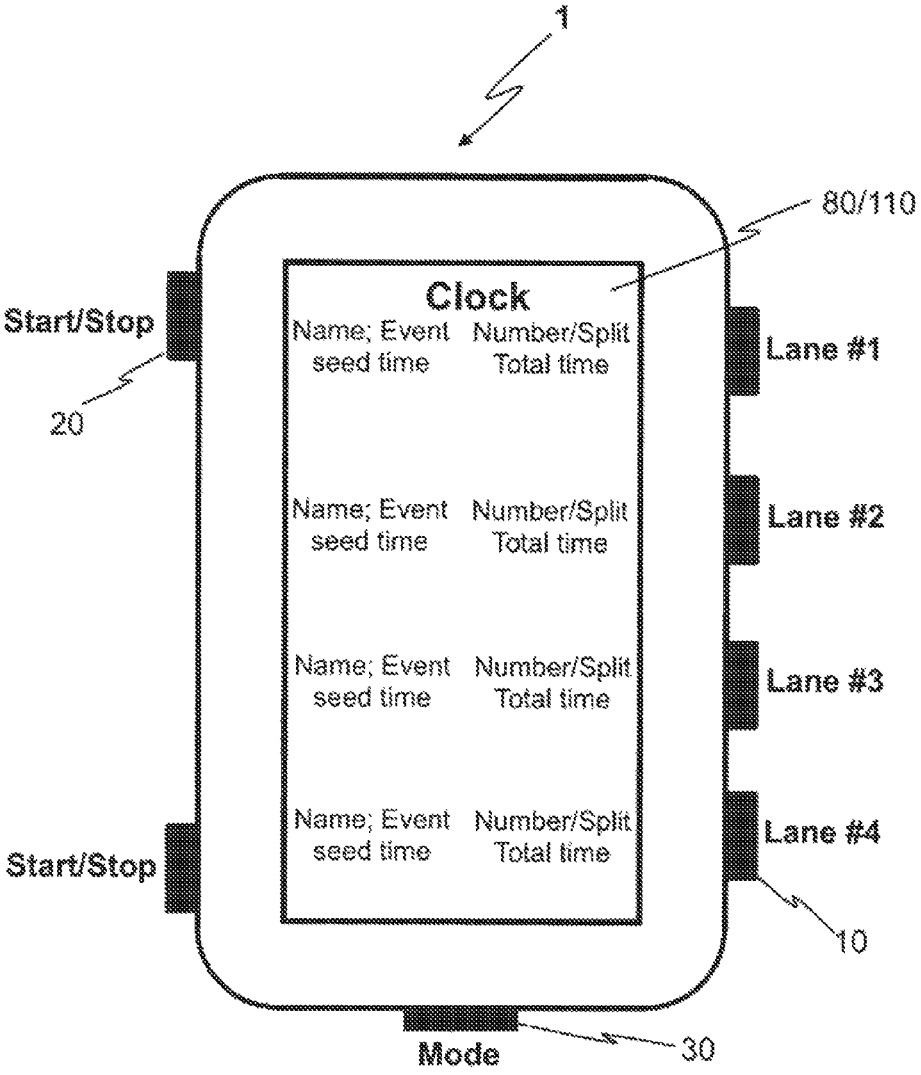

Referring to FIG. 1, there is disclosed a timing device, more particularly a multi-lane stop watch 1. The said multi-lane stop watch 1 comprises more than one split buttons 10, at least one start/stop button 20 and a mode selection button 30. The multi-lane stop watch 1 has a front side, a rear side, a top side, a bottom side and two lateral sides. The split buttons 10 are located on one of the lateral sides of the multi-lane stop watch for a user to easily access by using four fingers. Each split button is for one athlete. The start/stop button starts or stops the clock of all athlete's clock simultaneously. The setting of those buttons in the present invention can easily be changed for either right hand user or left hand user as shown in FIG. 1. FIG. 1A shows the setting of the buttons in the present invention when the multi-lane stop watch 1 is used by a right hand user. FIG. 1B shows the setting of the buttons in the present invention when the multi-lane stop watch 1 is turned 180 degrees by a left hand user.

Figure 2:
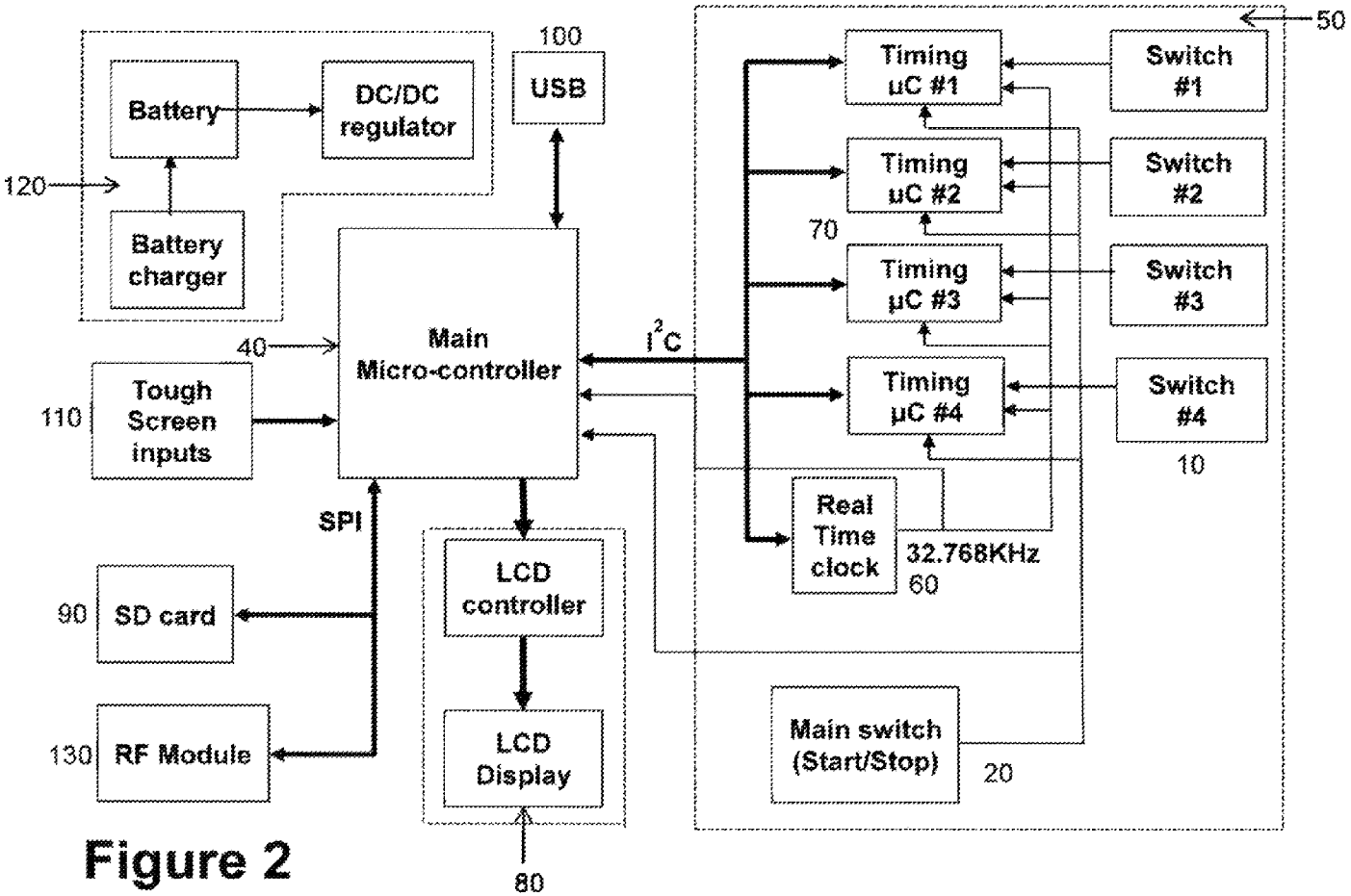
FIG. 2 is an exemplary block diagram of present invention

As shown in FIG. 2, said multi-lane stop watch 1 further comprises of a main micro-controller 40, a timing unit 50, a display unit 80, an input unit 110 and a power supply unit 120. The main micro-controller 40 is the processor to process all the information. The timing unit 50 records time for each athlete and it further comprises of a real time clock 60, more than one split time clock 70, split buttons 10 connected to each split time clock, and start/stop button 20 connected to all clocks. Said multi-lane stop watch also comprises of means of import/export data 100 from/to external devices such as a PC or a printer; means of storages for collected data 90.

In one embodiment of the present invention, said multi-lane stop watch uses touch screen input devices as its input unit 110 as shown in FIG. 1.

In another embodiment of the present invention, said multi-lane stop watch uses LCD devices as its display unit 80 as shown in FIG. 1.

In another embodiment of the present invention, the means of import/export data 100 is a USB port.

In another embodiment of the present invention, means of storages for collected data 90 can be a hard drive, a SD card device or a flash drive via USB port.

In another embodiment of the present invention, said multi-lane stop watch further comprises RF module 130 (FIG. 2) used as handhold device to control Pace Clocks.

In another embodiment of the present invention, said multi-lane stop watch comprises up to four split time clocks.

Yet in another embodiment of the present invention, said multi-lane stop watch also include a DC/AC regulator and a battery charger.

Figure 3:
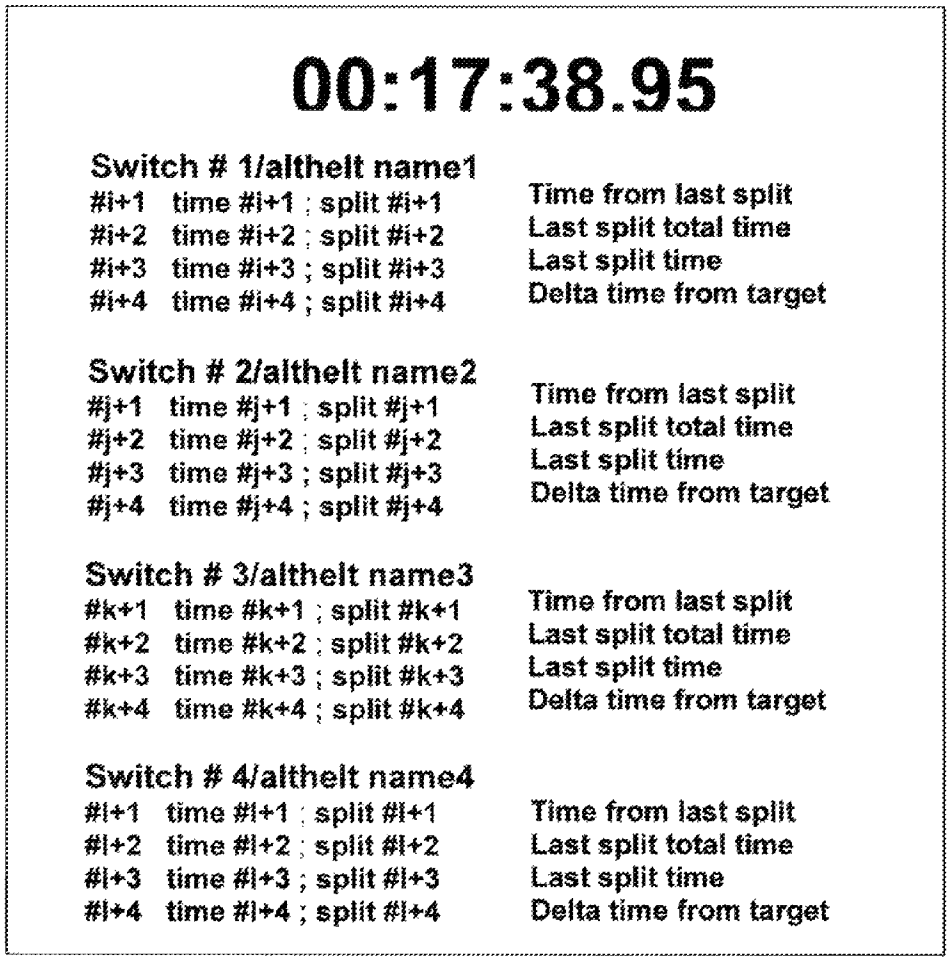
FIG. 3 shows an example display of present invention.

Said multi-lane stop watch can be used to record up to four athletes' time simultaneously. As one example of display as shown in FIG. 3, total time since the Start button was pressed is displayed on the top of the screen. The last split time since last split buttons were pressed is displayed on the left of the screen. Only last 4 splits will be shown on screen. If more than 4 splits are achieved, the split rows move up. The times of each athlete can be automatically saved in files which can be reviewed or print out later. The saved data can be up-loaded to a computer and also an athlete's best time, target split/final time, event qualify time, event record can be pre-loaded as reference. Other information can also be stored in the said multi-lane stop watch, such as team information, rosters, contact information, records, practice attendance, etc.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are entitled.

What is claimed is:

1. A multi-lane stop watch comprising:

a. a main micro-controller;

b. a timing unit comprising:

i. a real time clock;

ii. more than one split time clock;

iii. at least two split buttons connected to each split time clocks located on either one or the other side of the two lateral sides; and iv. two start/stop buttons connected to all clocks located on the opposite lateral side from where the split buttons are located;

c. an input unit;

d. a display unit;

e. means to import/export data;

f. means of data and information storages; and g. a power supply unit;

wherein the multi-lane stop watch has a front side, a rear side, a top side, a bottom side and two lateral sides, the split buttons are located on one of the lateral sides of the multi-lane stop watch for easy access by using fingers;

wherein the multi-lane stop watch can be used by both right and left hand users, the left hand user can use the same multi-lane stop watch by turning the multi-lane stop watch 180 degrees.

2. The multi-lane of stop watch of claim 1, wherein said input unit comprises touch screen input devices.

3. The multi-lane of stop watch of claim 1, wherein said display unit comprises LCD display devices.

4. The multi-lane of stop watch of claim 1, wherein said means to import/export data comprise USB ports.

5. The multi-lane of stop watch of claim 1, wherein said means of data and information storages includes a hard drive, a SD care device, and a USB flash drive.

6. The multi-lane of stop watch of claim 1, said multi-lane stop watch further comprises RF module used as handhold device to control Pace Clocks.

7. The multi-lane of stop watch of claim 1, said multi-lane stop watch comprises up to four split time clocks.

8. The multi-lane of stop watch of claim 1, wherein said power supply unit includes a DC/AC regulator and a battery charger.

9. A multi-lane stop watch comprising:

a. a main micro-controller;

b. a timing unit comprising:

i. a real time clock;

ii. four split time clock;

iii. four split buttons connected to each split time clocks located on one of the lateral sides; and iv. two start/stop buttons connected to all clocks located on the opposite lateral side of where the four split buttons are located;

c. an touch screen input device;

d. an LCD display;

e. a USB port to import/export data;

f. a hard drive, a SD card unit or a USB flash disk for data and information storage; and g. a power supply unit including a DC/AC regulator and a battery charger;

wherein the multi-lane stop watch has a front side, a rear side, a top side, a bottom side and two lateral sides, the split buttons are located on one of the lateral sides of the multi-lane stop watch for easy access by using fingers;

wherein the multi-lane stop watch can be used by both right and left hand users, the left hand user can use the same multi-lane stop watch by turning the multi-lane stop watch 180 degrees.

* * * * *